United States Patent [19]

Bly

[11] 4,030,433

[45] June 21, 1977

[54] METHOD OF FORMING CAPTIVE CAN CLOSURE

[76] Inventor: Herbert Arthur Bly, 10 Shadowstone Lane, Lawrenceville, N.J. 08648

[22] Filed: Apr. 5, 1976

[21] Appl. No.: 673,612

Related U.S. Application Data

[63] Continuation-in-part of Ser. No. 440,739, Feb. 8, 1974, Pat. No. 3,963,153.

[52] U.S. Cl. ..... 113/121 C

[51] Int. Cl.[2] ..... B21D 51/44

[58] Field of Search ..... 113/121 C, 121 R; 220/268, 269, 277, 345, 346; 222/541

[56] References Cited

UNITED STATES PATENTS

| | | | |
|---|---|---|---|
| 3,266,452 | 8/1966 | Taylor | 113/121 C |
| 3,363,798 | 1/1968 | Garangiotis | 220/345 |
| 3,760,752 | 9/1973 | Geiger | 113/121 C |

*Primary Examiner*—Michael J. Keenan

[57] ABSTRACT

A multiple stage punching and stamping process for the purpose of forming a tightly sealed integral closure in a can lid without use of additional material, and concurrently forming retaining and guiding grooves which allow the closure to be displaced laterally to provide an opening in the can.

1 Claim, 5 Drawing Figures

METHOD OF FORMING CAPTIVE CAN CLOSURE

This application is a continuation-in-part of application ser. no. 440,739, filed Feb. 8, 1974, now U.S. Pat. No. 3,963,153.

SUMMARY OF THE INVENTION

The object of the invention is to provide a method of forming, by a sequential die punching and stamping process, an integral sliding closure member in a can lid, retained in guided grooves before and after displacement to form the opening, without use of additional material, and tightly sealed before opening to prevent leakage of the contents of the can. The process utilizes two sets of mating dies in two sequential stations or positions. In the first station or position the can lid is held between the first pair of matching dies, which then come together shearing the closure portion from the lid and simultaneously rounding the edges of the closure portion. During this operation the closure portion is elastically deformed into a concave (or convex) surface. The mating dies, with the closure clamped between, then reposition the closure in the sheared opening in the can lid. The first pair of dies then open, and the can lid is indexed to the second station or position in the process. In the second station or position, the second pair of mating dies close, forming and extruding the edges of the lid opening around the rounded edges of the closure, providing a hermetic seal while simultaneously forming retaining and guiding grooves which allow the closure to be displaced laterally with respect to the can lid, to provide an opening in said can lid.

DRAWINGS

DETAILED DESCRIPTION

The present invention relates to a method of forming the integral closure portion of an improved easy-opening closure intended primarily for use on cans containing beverages and other liquids. This method of forming the closure was originally incorporated in Patent Application Ser. No. 440,739 LEVER ACTUATED CAPTIVE CAN CLOSURE, filed Feb. 8, 1974, now U.S. Pat. No. 3,963,153. As a result of a Requirement for Restriction in a subsequent action dated April 26, 1975, the pertinent claim relating to the method of formation was cancelled, and is made the subject of the present application.

FIGS. 1 through 5 depict the sequential punching and die forming steps employed to form the sliding closure integrally in the can lid without use of additional material, and concurrently forming retaining and guiding grooves to allow the closure to be displaced laterally to form the opening.

Figure 1:
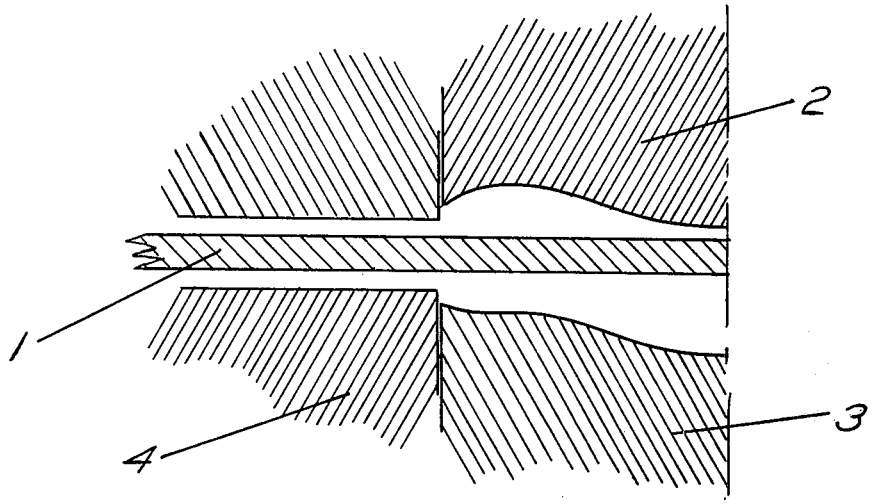
FIG. 1 is an enlarged section view through a portion of the first of two sets of dies used to integrally form the sliding closure member in the container lid, showing the dies in the open position with the container lid in position.
Figure 2:
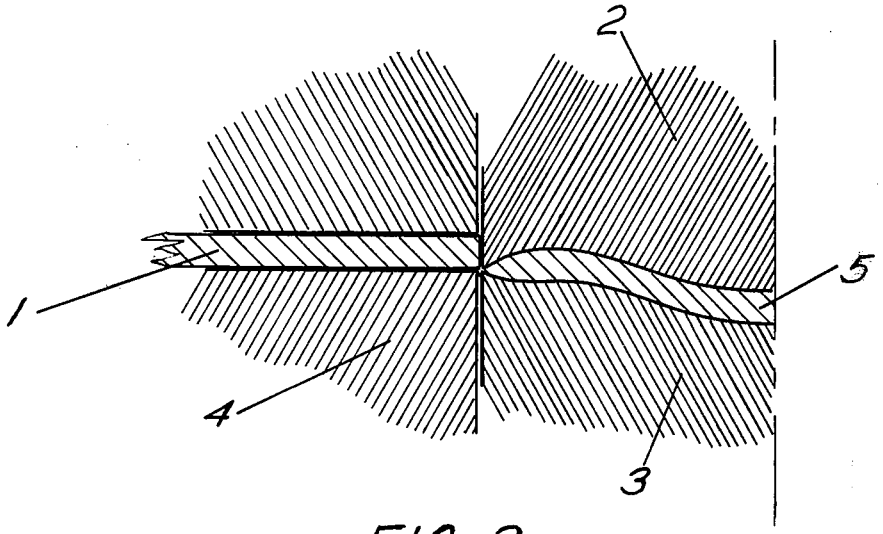
FIG. 2 is the enlarged section view of FIG. 1 with the dies closed.
Figure 3:
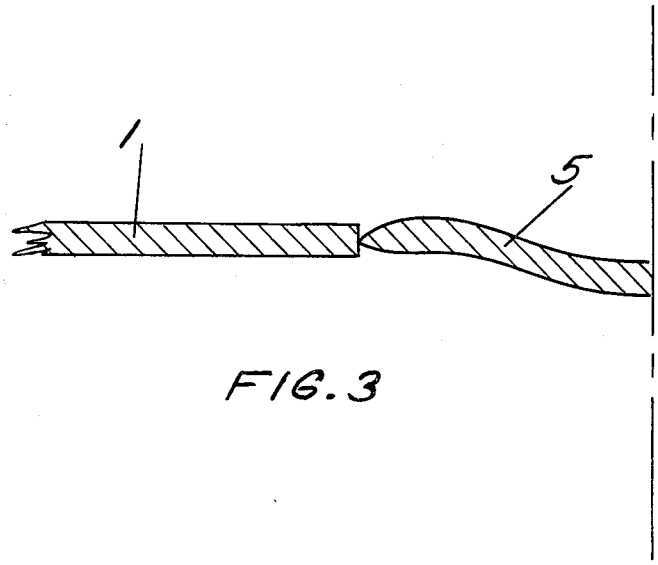
FIG. 3 is an enlarged section view of the container lid shown in FIG. 2 after the sliding closure member has been repositioned in the container lid opening.

In FIG. 1 the can lid 1 is shown in position at the first of two sequential die forming stations. Movable top die 2 and movable bottom die 3 are shown open. Bottom die 4 is fixed. In FIG. 2, the top 2 and bottom 3 movable dies have closed and moved downward with respect to the fixed die 4, shearing the closure portion 5 from the lid 1 and simultaneously rounding the edges of the closure 5. In FIG. 3 the top and bottom movable dies have moved upward and opened, repositioning the closure portion 5 in the center of the edges of the opening in lid 1.

Figure 4:
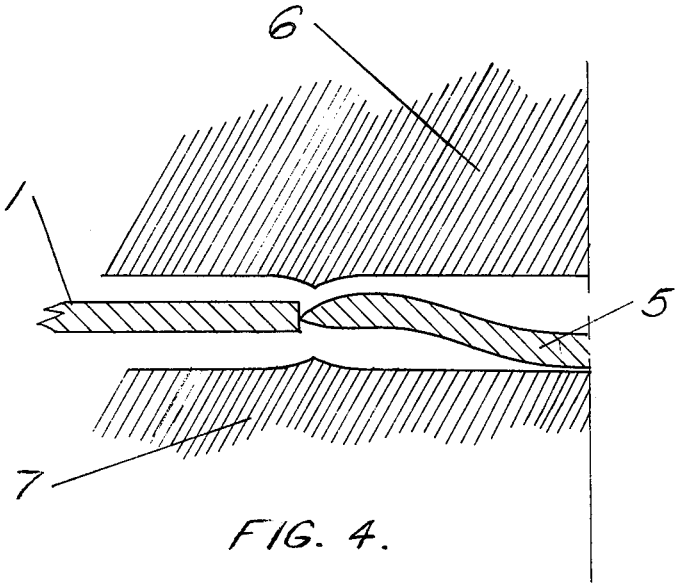
FIG. 4 is an enlarged section view of the container lid shown in FIG. 3 in position between the second of the two sets of dies.
Figure 5:
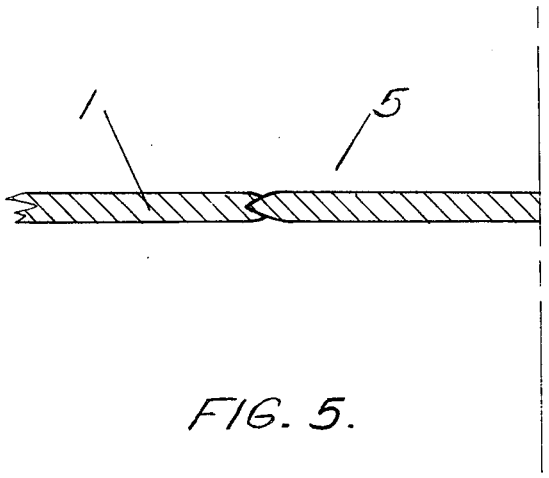
FIG. 5 is an enlarged section view of the container lid and closure after completion of the forming process.

In FIG. 4, the lid (with closure) has moved to the second of the two sequential die forming stations. The top and bottom dies 6 and 7 are shown immediately prior to closing when the edges of the opening in lid 1 will be formed around the rounded edge of the closure 5, as shown in FIG. 5, providing a hermetic seal while simultaneously forming retaining and guiding grooves allowing the closure to be displaced laterally with respect to the can lid. During the forming operation, the projected area of the closure 5 is increased due to extrusion of the rounded edges. To compensate for this area increase until the forming is complete, the enlarged surface may be temporarily and elastically held in a concave (or convex) form between the mating die surfaces.

To reduce friction and render the lateral displacement of the closure easier, the lateral sides of the closure may be slightly non-parallel and converging toward the end closest to the can rim.

I claim:

1. A method of integrally forming a sliding closure member in a can lid by sequential punching and die forming in four steps; firstly, punching said sliding portion, displacing it partially from the container lid, with complete shearing of the metal taking place; and secondly, forming the sheared edge of the closure member between two dies to round the inner and outer edges and extrude the metal, slightly increasing the projected area of the closure; thirdly, repositioning the sliding portion to its original position in the opening while clamping it between two rounded dies to reduce its projected area to that of the opening; and fourthly, forming the edges of the opening between two dies to conform to the rounded edges of the closure, causing extrusion of the edges of said opening, increasing its projected area and causing it to overlap and tightly seal against the edges of the closure while forming guide grooves for the sliding member, and restoring the plane surface of the container top, further increasing sealing pressure.

* * * * *